United States Patent [19]

Decoppet

[11] 4,068,419

[45] Jan. 17, 1978

[54] INSIDE SCAFFOLDING FOR LARGE METALLIC STRUCTURES AND METHOD OF USING SAME

[75] Inventor: Jean-Pierre Decoppet, Corseaux, Switzerland

[73] Assignee: General Dynamics Corporation, St. Louis, Mo.

[21] Appl. No.: 655,170

[22] Filed: Feb. 4, 1976

[30] Foreign Application Priority Data

Feb. 14, 1975 Switzerland ..... 1860/75

[51] Int. Cl.[2] ..... E04H 12/34

[52] U.S. Cl. ..... 52/40; 52/73; 52/127; 52/632; 52/645; 52/741; 182/128

[58] Field of Search ..... 52/741, 749, 632, 637, 52/645, 646, 748, 30, 40, 127, 73, 654, 747; 220/5 A, DIG. 29; 182/128

[56] References Cited

U.S. PATENT DOCUMENTS

| | | | |
|---|---|---|---|
| 1,517,006 | 1/1924 | Horton | 220/5 A |
| 1,966,244 | 7/1934 | Hansen | 52/582 X |
| 2,623,643 | 12/1952 | Seamans | 182/128 X |
| 3,018,546 | 1/1962 | Dewese | 52/747 |
| 3,166,154 | 1/1965 | Titzel | 182/128 |
| 3,298,154 | 1/1967 | Behr et al. | 52/749 |
| 3,306,396 | 2/1967 | Goss | 182/128 |
| 3,556,252 | 1/1971 | Atkins | 182/128 |
| 3,672,115 | 6/1972 | Abe et al. | 52/741 |
| 3,823,842 | 7/1974 | Chang | 220/5 A X |
| 3,888,062 | 6/1975 | Gregord | 182/128 X |

FOREIGN PATENT DOCUMENTS

| | | | |
|---|---|---|---|
| 1,417,198 | 10/1965 | France | 182/128 |
| 1,411,729 | 8/1965 | France | 182/128 |
| 483,978 | 8/1953 | Italy | 52/30 |
| 3,356 | 5/1914 | United Kingdom | 220/5 A |

*Primary Examiner*—Leslie Braun

*Attorney, Agent, or Firm*—Fitch, Even, Tabin & Luedeka

[57] ABSTRACT

The invention relates to a fabrication process of a metallic structure made of sheets welded one onto the other and enclosing an internal space. A scaffolding is erected in this internal space and comprises a vertical tower and collapsible passageways extending radially from said tower. When the structure is substantially terminated, the passageways are collapsed and the scaffolding is withdrawn from said space through an aperture provided at the upper part of the structure.

3 Claims, 2 Drawing Figures

INSIDE SCAFFOLDING FOR LARGE METALLIC STRUCTURES AND METHOD OF USING SAME

The erection of very large metallic surrounding structures poses difficult problems. In fact, to be able to erect such works with the necessary security factors as related to the kind of products stocked: natural gas petroleum, gasoline, etc. and technical criteria of storage, presure, temperature, etc., it is not sufficient to chose the best materials and fabrication processes, but in addition one must take all necessary and useful measures so that those responsible for fabrication can do the work in good conditions, which requires that they have good working position. This remark is particularly true for welders whose work must be very regular. In fact, the exterior appearance of completed welding seams does not allow verification of the real quality of the said seams which may hold internal defects.

The cost of inside fabrication scaffoldings for such structures is very high, and this even more so when the structure is large and the scaffolding allows good access at all points where there is a work operation to be performed.

Furthermore, in the case of light metal structures, it is recommended not to fasten the scaffolding to parts of the structure already built.

This invention concerns a scaffolding which can be peassembled in various elements which can be put together on the spot where the structure will be erected and which can be removed from the structure after its erection by an orifice at the top of reduced dimension provided for this purpose, the dissassembly of those preassembled elements can be subsequently accomplished on the outside of the structure.

Thus, the assembly and dissassembly operations of the elements can be accomplished in far better conditions than it would be possible if they had to be performed entirely on the fabrication site of the structure. This work simplification helps to considerbly lower the labor cost necessry for the assembly and dissassembly of the scaffolding. This savings is even larger when the fabrication of structures is repetitive, since the preassembled elements stay in the condition once removed from the structure and are reutilized for the erection of the following structure.

The planned preassembly can be very advanced and include with the scaffolding most of the required accessory equipment and tooling, for instance welding stations, distribution of various fluids such as shielding gas protection, compressed air, distribution of electricity with transformers, high frequency generators, etc.

The subject of the invention is a fabrication process of a metallic structure, whereby parts of the walls of this structure are assembled and welded one to the other by at least one worker placed inside the structure. This process is characterized by the fact that an interior scaffolding is erected with a tower and passageways radially extending from the tower, that one makes the assembly of wall sections and weldments by using this scaffolding, that one allows an opening to remain to the upper part of the structure, that one dissassembles the inside scaffolding, and that one extracts it from the structure by the said orifice.

The invention also includes a scaffolding for carrying out this process.

The attached drawing illustrates, schematically and by way of example, one embodiment of the scaffolding according to the invention.

FIG. 1 shows the lower half of a spherical container during its construction and the related scaffolding.

Figure 1:
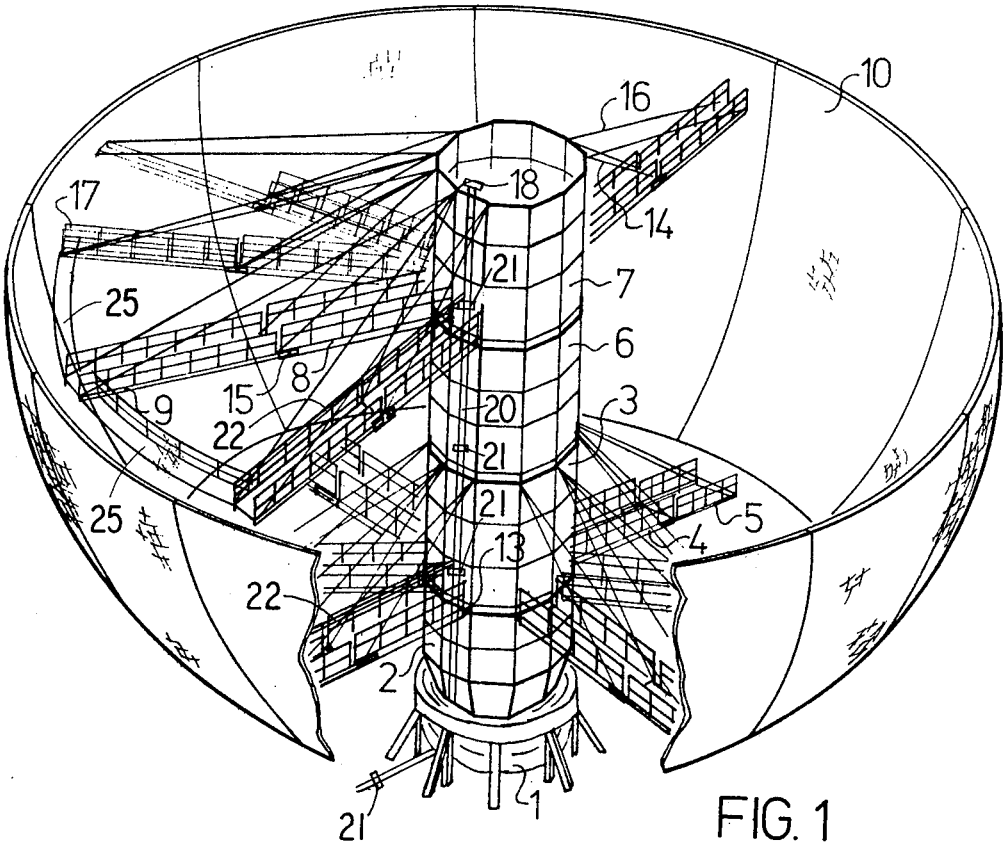
FIG. 1 shows a part of the scaffolding in working position.
Figure 2:
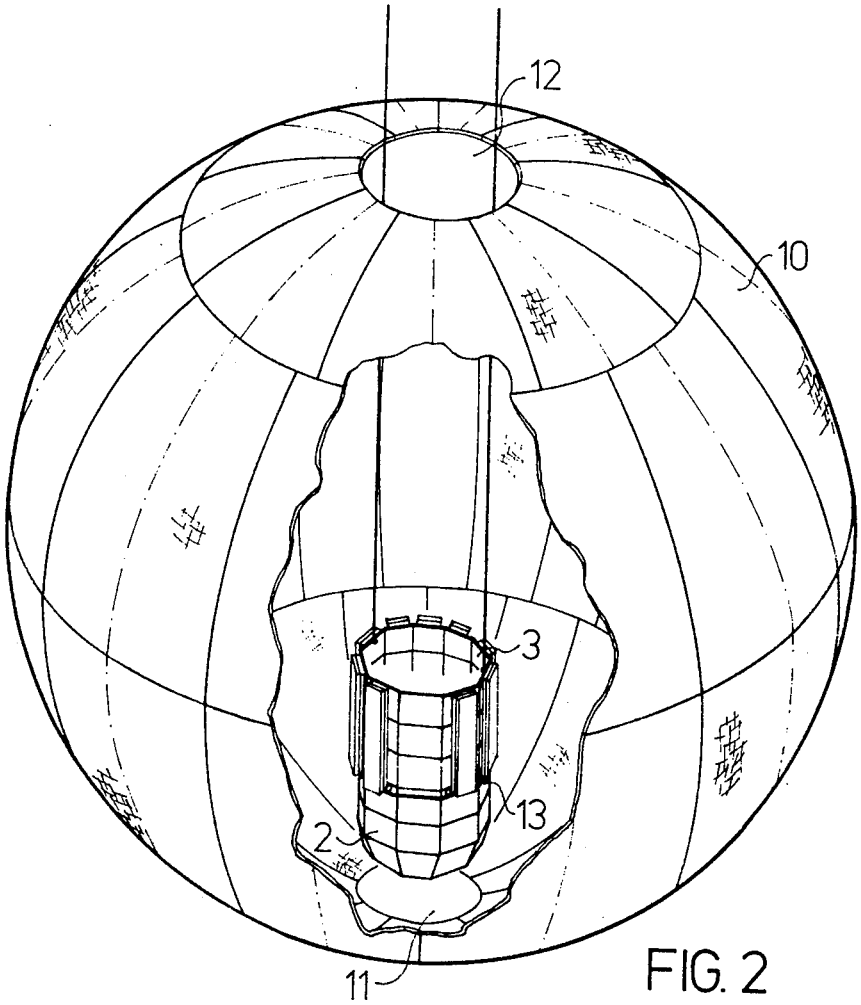
FIG. 2 illustrates a part of the scaffolding folded to allow its extraction from the built structure.

In order to complete the construction to obtain that shown in FIG. 2, the scaffolding will receive further vertical elements provided with further passageways. Furthermore, for the clarification of the drawing, all radial passageways of the median level have not been shown.

The base 1 of the tower is rigidly fixed to the ground of the work area. This base carries all the interior scaffolding comprising a vertical tower provided with radial passageways. The tower is divided in several sections fixed to one another and perfectly lined up. The lower section 2 of the tower base is rigidly fixed on the base 1 and carries section 3 which includes the lower level of passageways 4, 5, of which some 4 are secured to it, on the one hand by horizontal hinges 13 and, on the other hand, by stays 14 attached to the same section 3 at fixation points 18. By construction, those passageways 4 can be folded back against the tower like the stays of an umbrella. The maximum possible height of section 3 of the lower level, its passageways being folded back, is limited for practical reasons. It is therefore necessary to adapt the length of each passageway in such a way that, once folded, it does not hinder the withdrawal of the scaffolding sections from the container. Furthermore, when extended, its length must be sufficient to allow access to the interior wall of the container under fabrication. Therefore, the passageways are telescopic. The passageway 5 is carried on one hand by the passageway 4 interior, by the intermediary of a telescopic connection 15, and on the other hand by stays 16 to the tower. The connection 15 between the interior and exterior passageways can be made otherwise than telescopically, for example by means of hinge.

A second intermediary section of tower 6 carrying section 7 of the median stage of passagways includes passageways 8 and 9 telescopically mounted one onto the other and hung by stays 14 and 16.

The scaffolding for the completion of a sphere according to FIG. 2 could include also an upper section holding a level of higher passageways, not shown in the drawing.

FIG. 2 represents the end of the dissassembly operations, i.e. when the major work of the container has been completed and the upper level sections are already removed. To remove the remaining section, after having removed the safty railings, the telescopic passageways 5 are retracted and passageways 4 are folded back by means of the stays. In that position, the scaffolding holds very little horizontal space and can be easily withdrawn by orifice 12 of small diameter provided for this purpose.

As the scaffolding can be mounted and dissassembled in complete sections, it is possible to equip the said sections with all the equipment and tooling for fabrication operations such as welding stations, gas distribution, spare electrodes, etc. To facilitate this distribution, the feeder conduits 20 for these apparatuses in energy, gas, etc. can be brought to the scaffolding tower, then brought down along its side, then taken out at the base 1, and each one connected to its corresponding plug 21. During the dissassembly stage, it is sufficient to withdrawn within the tower these conduits 22 which, generally, are flexible and to fix them in the section where the equipment requiring power is located. In this manner, the connection of the working equipment is done and undone easily.

Also, when the containers are of very large size, it is advisable to provide means to facilitate the mobility of the work force throughout the site. For this purpose the tower can include a means of lifting, as for example an elevator with a cabin (not shown) hung on a winch and serving the tower vertically. Obviously, the entry of personal can be done by passing under the container being fabricated and entering by the base of the tower or with the help of an auxiliary tower, not shown in the drawing, erected vertically beside the container, and a connecting passageway allowing access at the top of the tower.

When the container under fabrication is a revolution surface, the scaffolding can be used by pivoting around the vertical axis of the tower which then rest on a pivot, the summit of the tower being guided in a bearing held by an auxiliary frame or by stays.

Auxiliary passageways 25 can be mounted to the extremities of the radial passageways of each level, connecting them with one another and in that way allow access to the interior wall of the container all along a horizontal line. In this same manner, the execution of the container meridians can be done with the help of auxiliary scaffoldings hung or respectively carried by horizontal passageways to the desired location, allowing personnel to follow meridian lines from the surface for the execution of their work.

To improve the security of the scaffolding, it is evident that the diverse passageways can include, as represented in the drawing, safety barriers which are dismountable or foldable to allow folding of the passageways.

The fabrication operations of the container includes first the erection of inside and outside scaffoldings, then the placing of the various preformed sheets, which are then positioned, one in relation to the other, by utilizing jacks and clamps holding these sheets in place. Adjustments being completed, these latter are spot-welded one to the other to hold them in their respective positions, which makes it possible to withdraw the clamps and jack previously used. When the work is completed on the entire container, it is self-supporting, independant of the scaffolding inside and outside. The real soldering operations can then be started. They will be done in a well determined order, so that the container will conserve its shape despite its consecutive deformations due to shrinkage caused by the welding seams.

During these operations, it is obviously possible to connect the radial passageways extremities to the container in order to increase the stability of the entire scaffolding.

I claim:

1. Removable scaffolding structure for constructing a spherical tank from metallic plates which comprises a free-standing central tower which is divided into a plurality of detachable sections that are aligned one section atop another and which tower contains equipment for the welding of the spherical tank, the lowermost section of said central tower being supported in base means that is fixed to the ground, each said detachable section being supported in turn upon the next lower section of said tower, radially extendable passageways connected to several of said tower sections by hinges at one end thereof, which passageways are each divided into at least two sections that are mutually displaceable, and stays connected to each of said passageways at a location spaced from said hinged end and to an upper location on said tower so as to support said passageways in working positions during welding operations in the construction of the spherical tank, said welding equipment including supply conduits for welding operations, which conduits are connected to corresponding plugs at the outside of the spherical tank structure through said base, connections between said supply conduits being made at each junction between said detachable sections and working connections to each of said supply conduits being provided as a part of each section of said tower which carries passageways, whereby after the completion of the welding operations, said passageways are pivotable about said hinges to be folded back to lie against said tower section to which each passageway is hinged, allowing each of said tower sections including the welding equipment contained therein to be withdrawn sequentially from the structure through an orifice of relatively small diameter which is left in the top of the spherical tank.

2. Removable scaffolding in accordance with claim 1 wherein auxiliary horizontal passageways are mounted at the extremities of adjacent radially extending passageways to provide access to interior wall of the sphere being constructed for 360° at one horizontal level.

3. A method for constructing a spherical tank from metallic plates using a removable scaffolding structure which method comprises erecting upon a fixed base a free-standing central tower which is divided into a plurality of detachable sections by aligning one section vertically atop another, said sections each containing supply conduits for welding, which conduits are connected to corresponding plugs outside of the region of the spherical tank structure through said base, interconnecting said supply conduits at each junction between adjacent tower sections, lowering radially extendable passageways which are connected to certain of said lower sections by hinges at the radially inner ends thereof using stays connected to each of said passageways at a location spaced from said hinged end and to an upper location on said tower so as to support said passageways in working positions during welding operations and extending said passageways to the full length thereof, assembling spherical metal wall sections using said extended passageways and spot-welding said metal sections to one another to create a self-supporting spherical surface having an opening at the top thereof, welding along the entire periphery at the interior surface of each of said spot-welded metal wall sections to create seams that provide a fluidtight tank by working from the passageways in a predetermined order to accommodate deformation caused by shrinkage at said welded seams, and following completion of said welding, folding said hinged passageways against said tower and dismantling said interior scaffolding and withdrawing it section by section from the surrounding spherical tank through said top opening.

* * * * *